US005584770A

United States Patent [19]

Jensen

[11] Patent Number: 5,584,770

[45] Date of Patent: Dec. 17, 1996

[54] PERIMETER WEIGHTED GOLF CLUB HEAD

[76] Inventor: Morten A. Jensen, 28734 Darrow Ave., Saugus, Calif. 91350

[21] Appl. No.: 452,333

[22] Filed: May 26, 1995

Related U.S. Application Data

[63] Continuation-in-part of Ser. No. 384,156, Feb. 6, 1995, abandoned.

[51] Int. Cl.[6] ..... A63B 53/04

[52] U.S. Cl. ..... 473/350; 473/334; 473/338; 473/345

[58] Field of Search ..... 273/77 R, 77 A, 273/167 R, 167 F, 169, 171, 173, 164.1, 193 R, 194 D, 194 A, 167 H; 473/324, 334, 338, 345, 350, 349

[56] References Cited

U.S. PATENT DOCUMENTS

| | | | |
|---|---|---|---|
| 3,995,865 | 12/1976 | Cochran et al. | 273/167 F |
| 4,824,110 | 4/1989 | Kobayashi | 273/169 |
| 5,056,705 | 10/1991 | Wakita et al. | 273/173 |
| 5,251,901 | 10/1993 | Solheim et al. | 273/172 |
| 5,377,985 | 1/1995 | Ohnishi | 273/169 |

FOREIGN PATENT DOCUMENTS

| | | | |
|---|---|---|---|
| 2174009 | 10/1986 | United Kingdom | 273/167 F |
| 2238251 | 5/1991 | United Kingdom | 273/169 |
| 2251556 | 7/1992 | United Kingdom | 273/167 R |

*Primary Examiner*—William M. Pierce
*Attorney, Agent, or Firm*—Albert O. Cota

[57] ABSTRACT

A perimeter weighted golf club head which has a body (40) defining a hosel (42), a heel (44), a ridge (46) of top (74), a sole (48) and toe (50). The combination forming a front face (52) and rear wall (54). The rear wall contains an integral mating surface (56) around which a weighted skirt (60) is attached. The skirt completely surrounds the periphery of the front face of the body and is of a metal heavier in equivalent mass weight than the body base material. The skirt material includes but is not limited to tungsten, depleted uranium, lead and their alloys in the base state or sintered together. The skirt is attached to its mating surface by brazing, swaging or using structural adhesives. A second embodiment includes a hollow (66) around the perimeter in which molten lead is poured. A third embodiment utilizes a segmented weighted skirt in a number of pieces to customize the head to the golfer. Both iron-type and wood type golf club heads are included in this invention.

3 Claims, 8 Drawing Sheets

PERIMETER WEIGHTED GOLF CLUB HEAD

CROSS REFERENCE TO RELATED APPLICATION

This application is a continuation-in-part of application Ser. No. 08/384,156 filed Feb. 6, 1995 now abandoned.

TECHNICAL FIELD

The present invention pertains in general to golf club heads and more specifically to perimeter weighted type of iron and wood type heads with a separate heavier metal skirt attached to the rear wall.

BACKGROUND ART

Previously, many types of perimeter weighted golf club heads have been used in endeavoring to provide an effective means for producing an ideal head that maximizes the ability of the club to not only provide optimum performance when the ball is struck precisely on the center of percussion but one that expands the area of the so called "sweet spot" to be mote forgiving if the ball is miss-hit. Attempts in this area include a centrally located complimentary weight of patent metal of lead, various configurations of the perimeter, dual counterweights, separate weighted elements embedded in the head, etc.

A search of the prior art did not disclose any patents that read directly on the claims of the instant invention, however the following U.S. patents are considered related:

| U.S. Pat. No. | INVENTOR | ISSUED |
|---|---|---|
| 5,356,138 | Chen et al | 18 October 1994 |
| 5,242,167 | Antonious | 7 September 1993 |
| 5,046,733 | Antonious | 10 September 1991 |
| 4,938,470 | Antonious | 3 July 1990 |
| 4,915,386 | Antonious | 10 April 1990 |
| 4,326,326 | MacDonald | 27 April 1982 |
| 3,941,390 | Hussey | 2 March 1976 |

Chen et al in U.S. Pat. No. 5,356,138 discloses a dual weight correlated set of iron-type golf clubs. The balancing weight in the cavitated back gradually increases in thickness toward the sole to provide better balance and strength behind the hitting surface of the club. A second mound weight reinforces the sole and rises to a peak filling the back of the cavity behind the lower segment.

Antonious in U.S. Pat. No. 5,242,167 discloses a perimeter weighted iron type golf club having a back cavity and a peripheral mass. Centrally located within the cavity is a geometrically shaped mass weight member that is located at the center of percussion of the golf club head.

The same inventor as above in U.S. Pat. No. 5,046,733 utilizes a pair of peripheral masses projecting from the rear surface of the club. The two masses are adjacent to the outer perimeter and to each other between the center of gravity of the club and the outer perimeter.

Antonious further teaches in U.S. Pat. No. 4,938,470 a perimeter weighted iron type golf club head with a combined upper alignment and sighting area formed on the top ridge to aid the golfer in aligning the club head square to the intended line when addressing the ball.

U.S. Pat. No. 4,915,386 also issued to the same Antonious uses a raised concentric mass weight member within the perimeter weighted rear cavity located at the center of percussion of the golf club head. The weight member is semi-hemispherical or truncated cylindrical shape.

MacDonald's U.S. Pat. No. 4,326,326 employs a threaded lead insert of selected weight and length positioned into the cavity directly behind the center of the striking surface in the rear face of the golf club head.

Hussey in U.S. Pat. No. 3,941,390 discloses a golf club head of a parent material, such as wood, and a weighted material, such as sheet metal positioned at the sides of the club head. The weighted material is positioned to increase the inertia effect and locate the center of gravity of the head in alignment with the shaft centerline. The soleplate is also designed to increase the inertia effect of the head.

For background purposes and as indicative of the art to which the invention relates, reference may be made to the following U.S. patents found in the search.

| U.S. Pat. No. | INVENTOR | ISSUED |
|---|---|---|
| 3,250,536 | Moser | 10 May 1966 |
| 1,627,848 | Hubbard | 10 May 1927 |
| 1,543,691 | Beat | 30 June 1925 |

DISCLOSURE OF THE INVENTION

Much effort has been directed to the development of the perimeter weighted or cavity-back expanded "sweet spot" golf club heads. This type of head relocates a greater portion of the parent material on the back of the head toward the outer edges leaving an indentation or cavity in the center of the head. The purpose of this structural orientation, moving the mass toward the outer edges, greatly increases the forgiveness of the club on off center hits or so called miss-hits. The invention not only achieves this goal but it is a primary object to expand this concept by the utilization of a denser, heavier material disposed peripherally on the rear wall of the head. This heavier material may be tungsten, sintered tungsten, lead, lead alloy or even depleted uranium. The head material is generally carbon steel, stainless steel, bronze or titanium causing the inventions perimeter weighting material to be from 1.5 to 2.5 times heavier than that of the club. The head material, in some cases, can also be constructed of a ceramic or a composite material. Since the overall weight of the head will not change, the cavity area opposite the striking surface will increase in size. Thus, expanding the center of percussion which then causes off center hits of the ball to travel further and straighter therefore, producing a more forgiving golf club.

An important object of the invention is the increased resistance to twisting or "radius of gyration". When the ball is hit, the polar moment of inertia is directed toward the mass which has been relocated outwardly toward the edges of the clubs striking face. The head seeks the center of gravity however, since the weight is further away, the club has less tendency to twist when a miss-hit is made as the moment arm is further from the center.

Another object of the invention is the ability of the club to be flexible in its manufacturing procedures as the weighted skirt may be attached after the head is cast or forged. The tooling for different heads may be adjusted to the proper angle of attack in loft and lie. Also, the same weight head may be used for steel and graphite shafts and the differential may be compensated for in the attached weighted skirt.

Still another object of the invention is directed to the ease in which the weighted skirt may be attached to the head as a myriad of methods exist in present technology well adapted to the application such as brazing, swaging casting or structural adhesives. With these methods available, fabrication is simple and the expense, is cost effective from both a manufacturer and consumer points of view.

In a third embodiment of the invention, yet another object of the invention is the use of a segmented weighted skirt. This skirt is formed in contiguous segments or it may not completely surround the periphery of the golf club head instead only parts of the circumference are covered by one or more segments. This configuration permits a great latitude in combinations of materials, sizes and shapes to completely cover a wide range of players and even allow a customized club for individuals. This customization is accomplished by employing a set of criteria for the players physical attributes and style and even clubs with removable skirts to find the optimum combination.

These and other objects and advantages of the present invention will become apparent from the subsequent detailed description of the preferred and other embodiments also the appended claims, further, taken in conjunction with the accompanying drawings.

BRIEF DESCRIPTION OF THE DRAWINGS

FIG. 1 is a partial isometric view of the preferred embodiment of the iron type golf club head with the skirt brazed or bonded on.

FIG. 17 is a partial isometric view of the preferred embodiment of the iron type golf club head with the skirt brazed, bonded, cast or swaged on.

BEST MODE FOR CARRYING OUT THE INVENTION

The best mode for carrying out the invention is presented in terms of a preferred, second and third embodiment. All embodiments are primarily designed alike except the second embodiment is for an enclosed metallic wood type golf club head requiring a slightly different configuration to locate the skirt inside the head whereas the iron-type head is accessible from the outside. The third embodiment is the same as the preferred except the weighted skirt is segmented.

Figure 32:
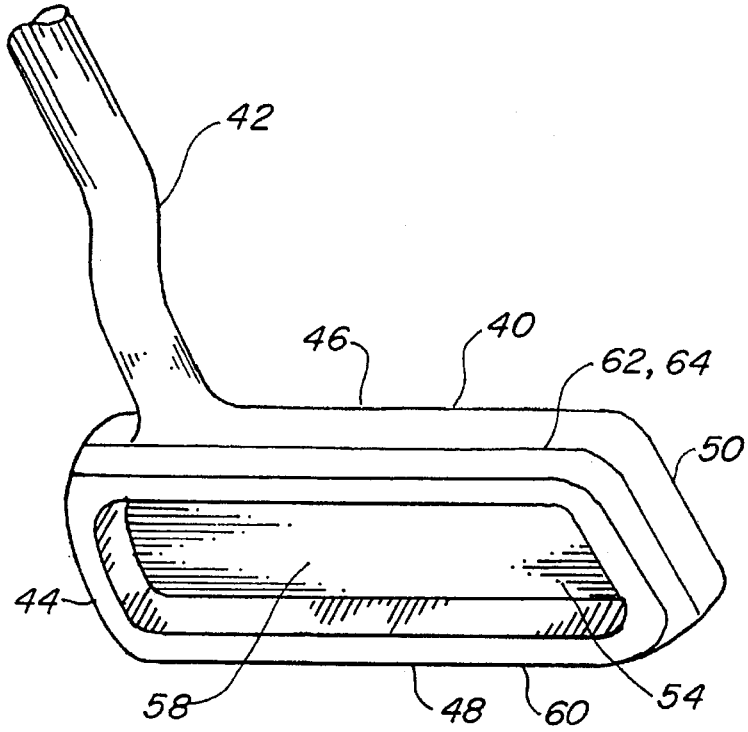
FIG. 32 is a preferred embodiment of a putter golf club head with the skirt brazed or bonded thereon.

The preferred embodiment, as shown in FIGS. 1 through 21 and 32 through 34 is comprised of a metallic body 40 with a hosel 42 for attachment to a shaft, a heel 44 next to the hosel, an upper top ridge 46 and a sole 48 on the bottom both touching the heel and a toe 50 opposite the heel. The combination forming the periphery of the head and the remaining sides consist of a front striking face 52 and a rear wall 54. FIGS. 1, 6, 11 and 17 depict the complete head in the so called iron-type club and FIG. 32 illustrates the putter configuration.

Figure 1:
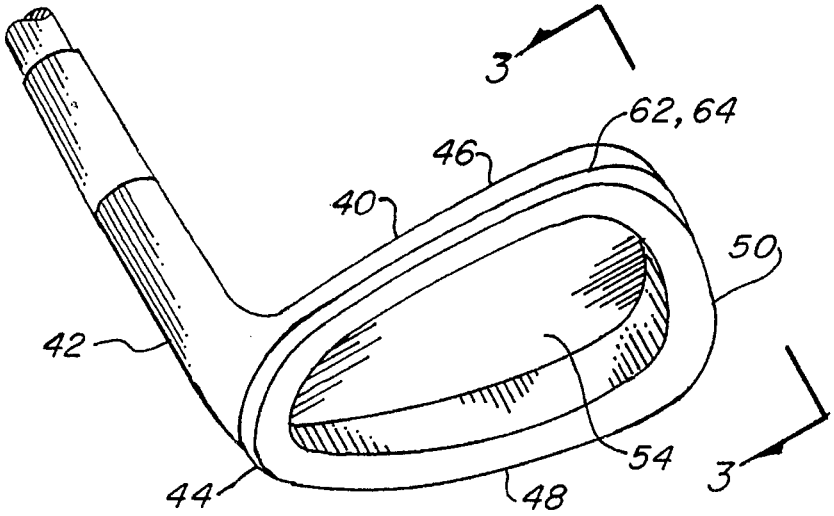
Figure 2:
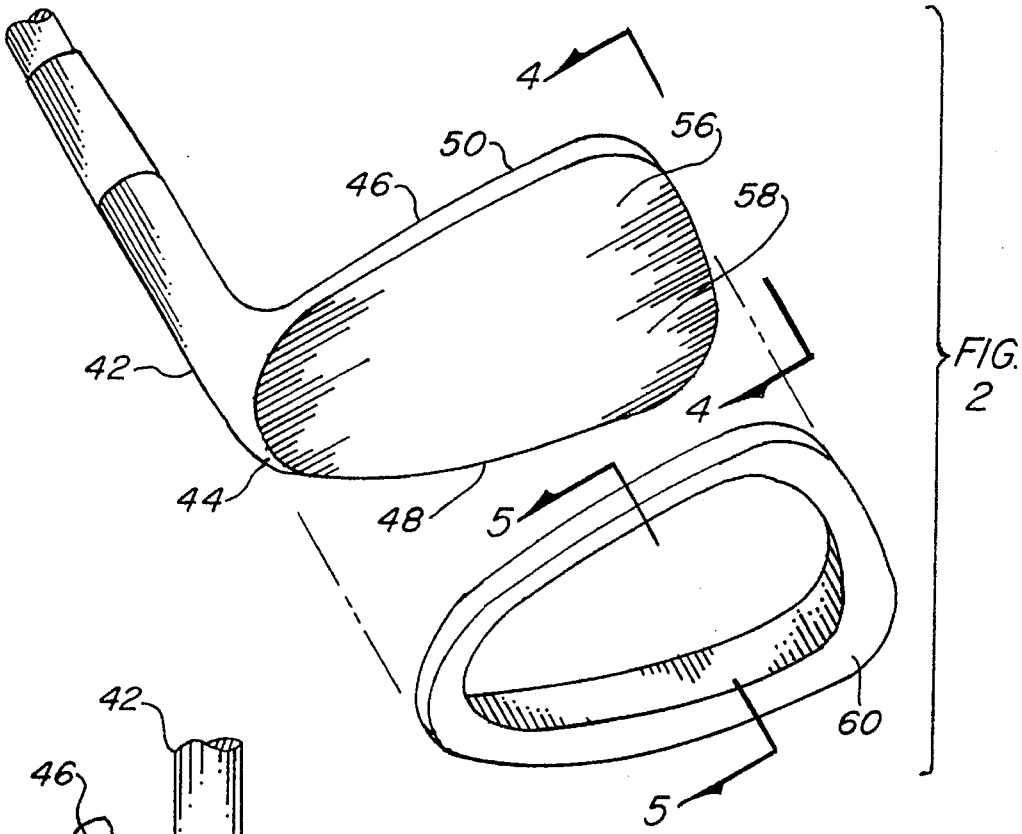
FIG. 2 is an exploded partial isometric view of the head and skirt.
Figure 3:
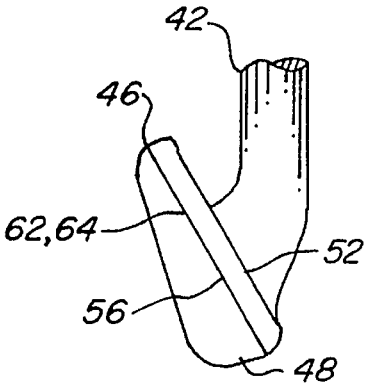
FIG. 3 is an end view taken along the lines 3—3 of FIG. 1.
Figure 4:
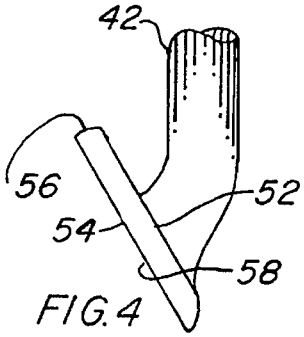
FIG. 4 is an end view taken along the lines 4—4 of FIG. 2.
Figure 5:
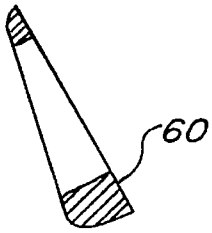
FIG. 5 is a cross-sectional view taken along lines 5—5 of FIG. 2 illustrating the skirt.
Figure 6:
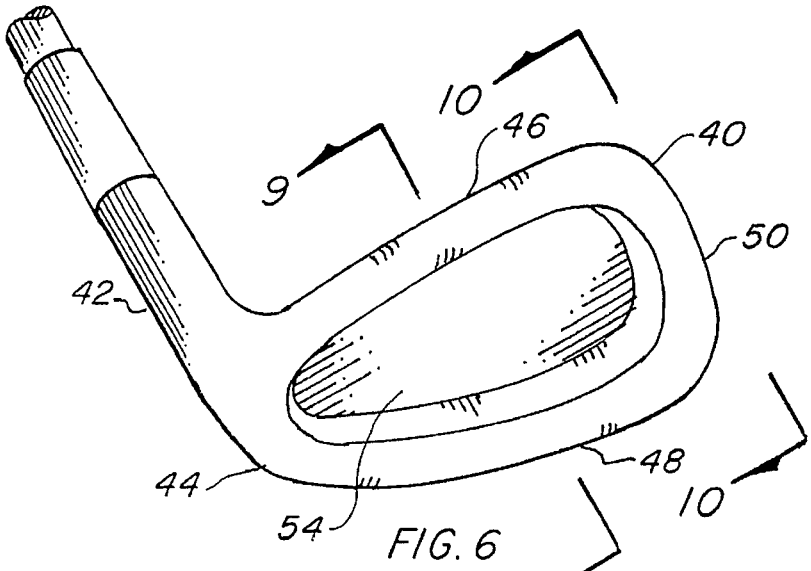
FIG. 6 is a partial isometric view of the preferred embodiment of the iron type golf club head with the skirt cast into the head.
Figure 7:
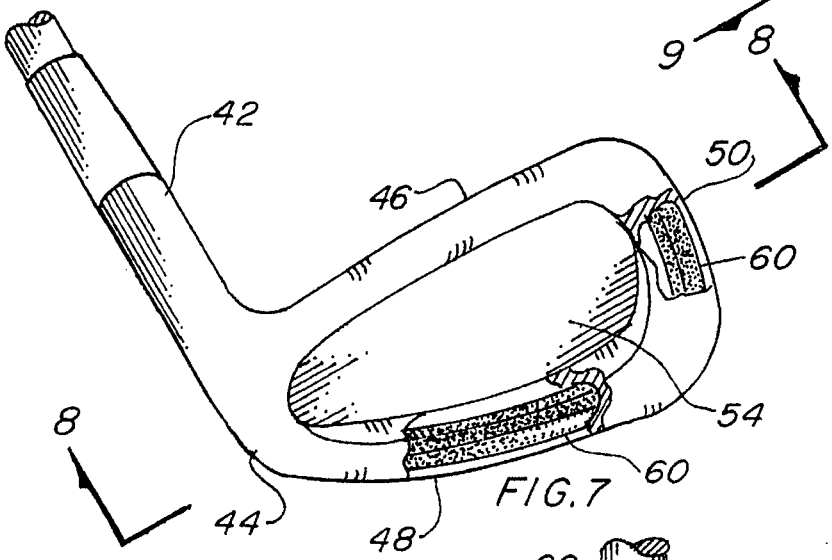
FIG. 7 is a partial isometric view of the Preferred embodiment as above cut away to show the location of the skirt.

The body 40 of the golf club head contains an integral mating surface 56 completely around the outside edge of the heel 44, ridge 46, toe 50 and sole 48 in a number of separate configurations. FIGS. 1–4 utilize a completely flat surface 58 as best shown in FIGS. 2 and 4 and therefore designated the flat surface configuration. The flat surface 58 is not only around the edge but across the entire rear wall 54. The putter uses the same flat embodiment depicted in FIGS. 32 and 33.

Figure 33:
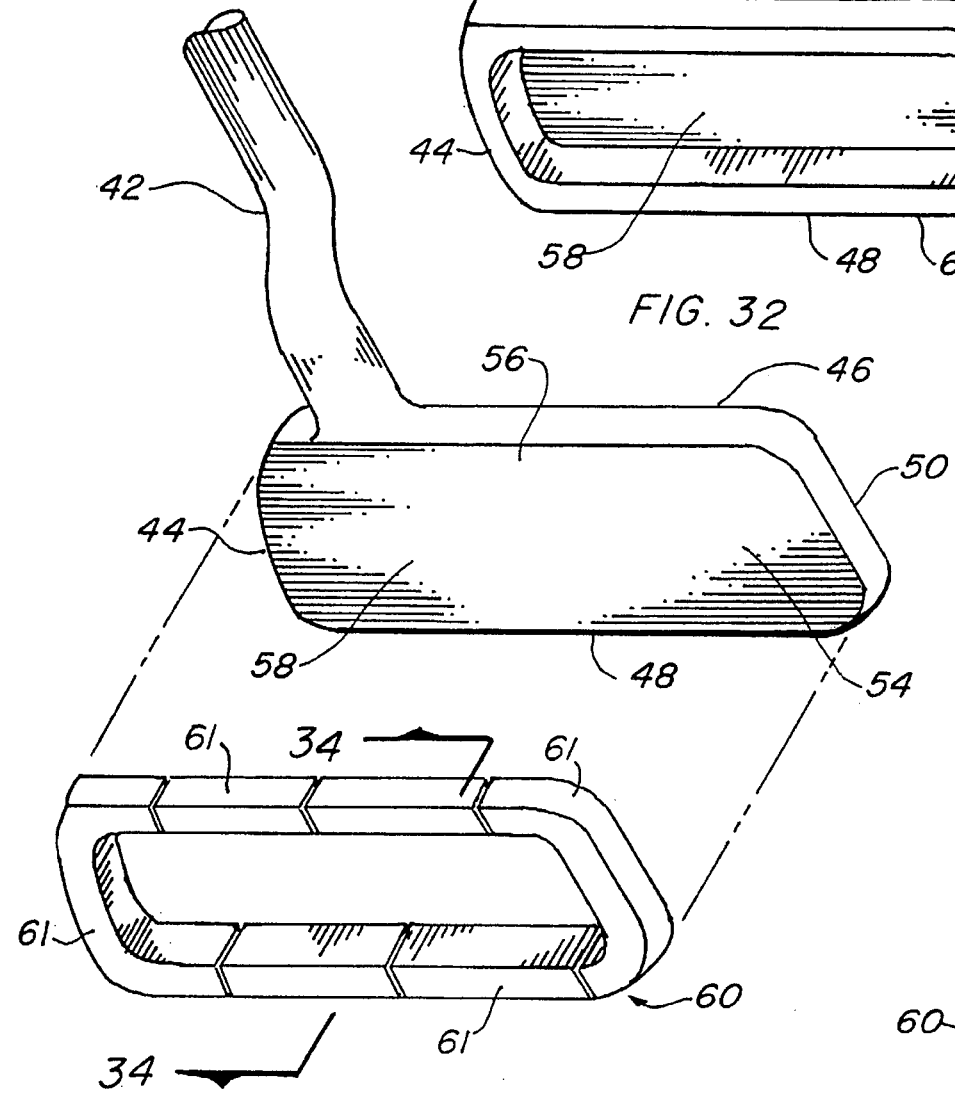
FIG. 33 is a exploded view of a putter.
Figure 34:
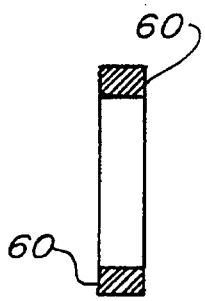
FIG. 34 is a cross sectional view taken along lines 34—34 of FIG. 33.
Figure 35:
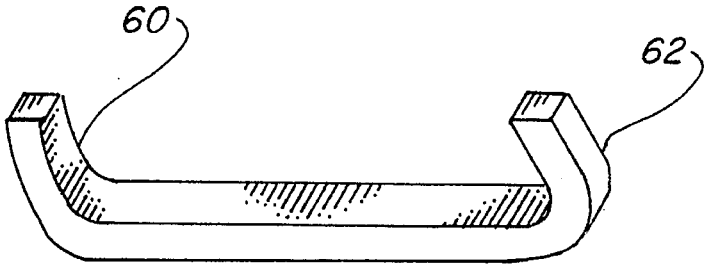
FIG. 35 is a partial isometric view of the segmented skirt in "U" shape completely removed from the invention for clarity.
Figure 36:
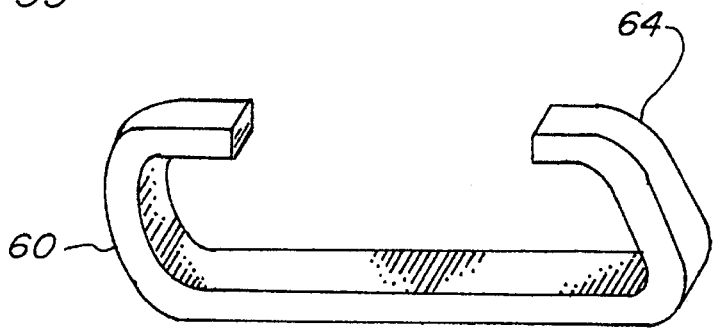
FIG. 36 is a partial isometric view of the segmented skirt in inverted "C" shape completely removed from the invention for clarity.

A mating weighted skirt 60 conforms to the flat surface 58 on the mating edge and is thin at the ridge 46 and wider at the toe 50, heel 44 and sole 48 and has the exact same shape on the perimeter. This skirt 60 is shown separate from the body 40 in FIGS. 2 and 34 and in cross section in FIGS. 5 and 33. The skirt 60 is formed of a metal heavier in equivalent mass weight than the body 40 base metal which is usually carbon steel, stainless steel, bronze or titanium. The preferred material for this flat embodiment is tungsten in its base state or sintered tungsten in combination with copper and nickel or other material to facilitate the bonding of the metal powder. Also, the weighted skirt 60 can be segmented into separate segments 61 as shown in FIG. 33.

Fastening means for joining the skirt 60 to the flat surface 58 is preferably a welding process known as brazing with a non ferrous filler metal 62 having a melting point below that of both the body 40 and the skirt 60. Since steel melts at 1315 degrees C. and tungsten at 3370° C., silver alloy types are preferred. These filler materials normally consist of silver, copper, zinc and perhaps cadmium. Phosphorous copper alloy with or without silver, is also an acceptable filler metal having a slightly higher flow point temperature. When the mass is heated above the melting point of the filler metal alloy, capillary attraction causes the alloy to flow into the space between the two parent metals. In any event, the brazing coalescence produces a permanent bond not affected by the shock loading when hitting the ball.

The flat surface embodiment may also utilize any number of available structural adhesives 64 as the fastening means. These adhesives include one or two part epoxies which have great shear strength and good gap filling capability, acrylics in two part combinations specifically for bonding metals, cynoacrylates which are strong and fast curing and anaerobics that cure in the absence of oxygen.

In this flat embodiment, the material of the skirt 60 is hard and not susceptible to deforming, therefore no lip of parent metal from the head 90 is required for protection. It may now be easily seen that this embodiment produces a golf club head not unlike the perimeter weighted types presently available on the market however, the weight distribution and center of gravity differ sufficiently to achieve the objects of the invention.

Figure 9:
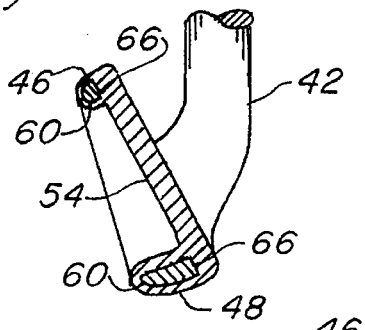
FIG. 9 is a cross sectional view taken along lines 9—9 of FIG. 7.
Figure 8:
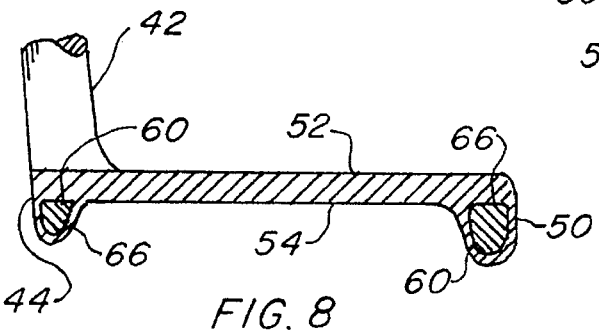
FIG. 8 is a cross sectional view taken along lines 8—8 of FIG. 7.
Figure 10:
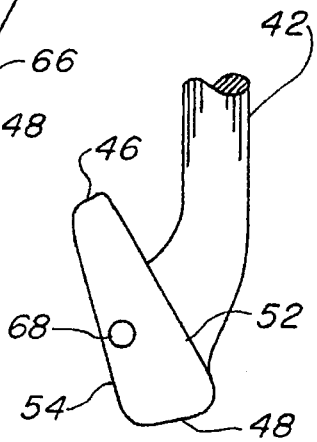
FIG. 10 is an end view that shows a fill hole and that is taken along the lines 10—10 of FIG. 6.
Figure 11:
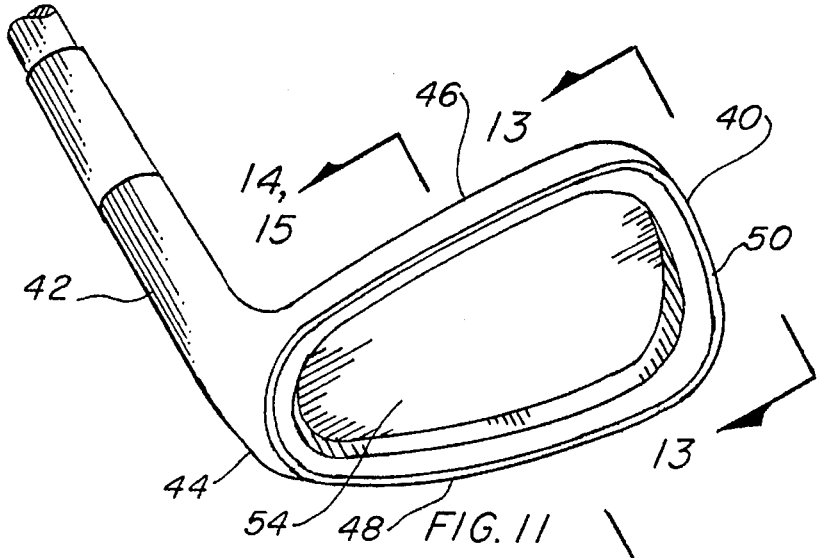
FIG. 11 is a partial isometric view of the preferred embodiment of the iron type golf club head with the skirt cast or bonded onto the head.

FIGS. 6–10 illustrate the hollow embodiment of the iron-type golf club head. The body 40 includes a hollow portion 66 completely around the heel 44, ridge 46, sole 48 and toe 50. Again, the ridge is smaller than the remaining parts, as best illustrated in FIGS. 8 and 9. Lead is used in this embodiment as the metal for the weighted skirt 60. The fastening means for attachment is simply to melt the lead and cast or pour it into the hollow 66 through a fill hole 68 in the toe of the body 40. This procedure completely captivates the metal inside. Lead melts at 991 degrees C. below that of steel, therefore this type of fastening means is practical and easily accomplished. This configuration is almost unrecognizable from the outside of the existing prior art primeter weighted heads except the walls surrounding the cavity in the rear wall 54 are thinner due to the greater weight density of the lead. The fill hole 68 may optionally be plugged or the lead may be exposed from the outside.

An alternative method of this embodiment may be a ring of tungsten placed inside a mold and the steel cast or forged around the ring locating the heavier metal inside. This is possible as tungsten melts at almost 2000 degrees C. above that of steel.

Figure 12:
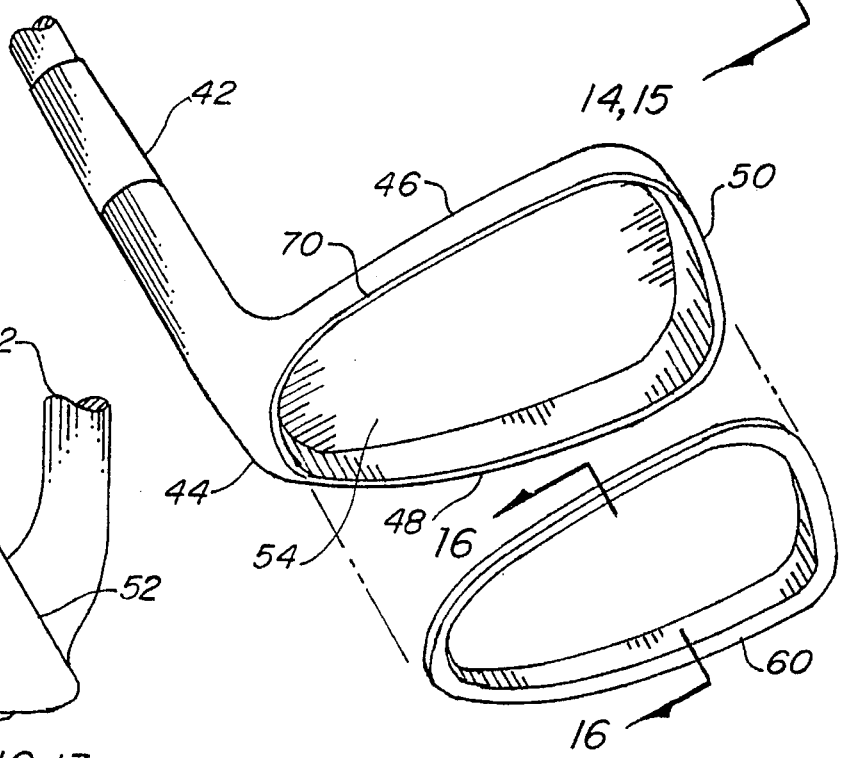
FIG. 12 is an exploded partial isometric view of the head and skirt.
Figure 13:
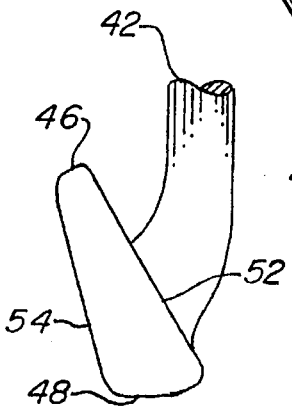
FIG. 13 is an end view taken along the lines 13—13 of FIG. 11.
Figure 14:
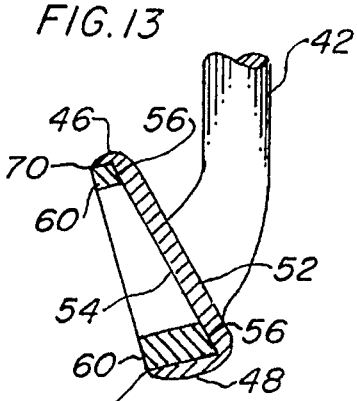
FIG. 14 is a cross sectional view taken along lines 14—14 of FIG. 11.

FIGS. 11–16 illustrate the skirt protected embodiment. The body 40 includes a protective raised peripheral lip 70 around the perimeter of the rear wall 54 that distends outwardly as shown in FIG. 12. This lip 70 is an extension of the parent metal of the body 40 and protects the inserted skirt 60.

As the lip 70 protects the skirt 60 from damage, the material of the skirt may be lead, lead alloy such as an amalgam of lead with a small amount of tin for casting quality and antimony for hardness, tungsten, sintered tungsten with lead or any other metal heavier in equivalent mass weight than the body base material.

Figure 15:
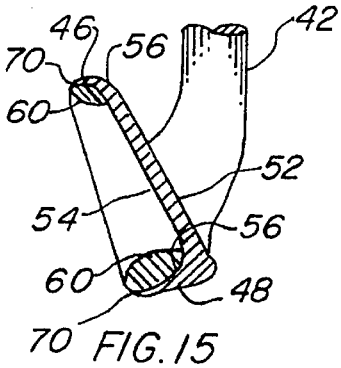
FIG. 15 is a cross sectional view taken along lines 15—15 of FIG. 11.
Figure 16:
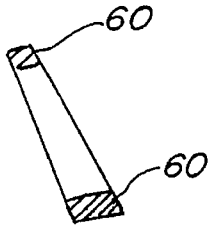
FIG. 16 is a cross sectional view taken along lines 16—16 of FIG. 12.

The fastening means for the skirt 60 to the club body 40 may use the forementioned brazing, adhesives, or even casting in place with an internal removable mold for the lead type material. FIG. 15 illustrates another configuration of the lip 70 and skirt 60 wherein the inner face of the two is radiused and the internal shape of the skirt is rounded inwardly.

FIG. 17–21 illustrate the skirt partially encased embodiment. The body 40 includes an outwardly extended channel 72 having a pair of legs in "u" shape on the periphery of the rear wall 54 of the club. This channel 72 protects both sides of the skirt 60 when it is disposed therewithin. The channel 72 is an extension of the parent metal of the body 40 and protects three sides of the skirt 60.

Figure 17A:
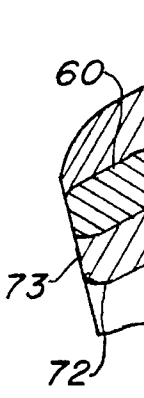
FIG. 17*a* is a cross-sectional view taken along lines 17*a*—17*a* of FIG. 17 illustrating the swaged skirt.
Figure 17:
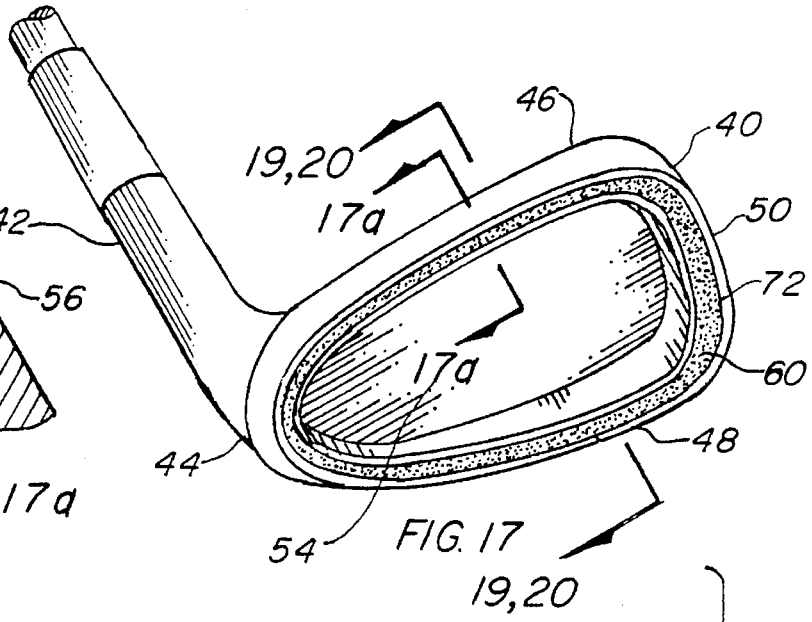
Figure 18:
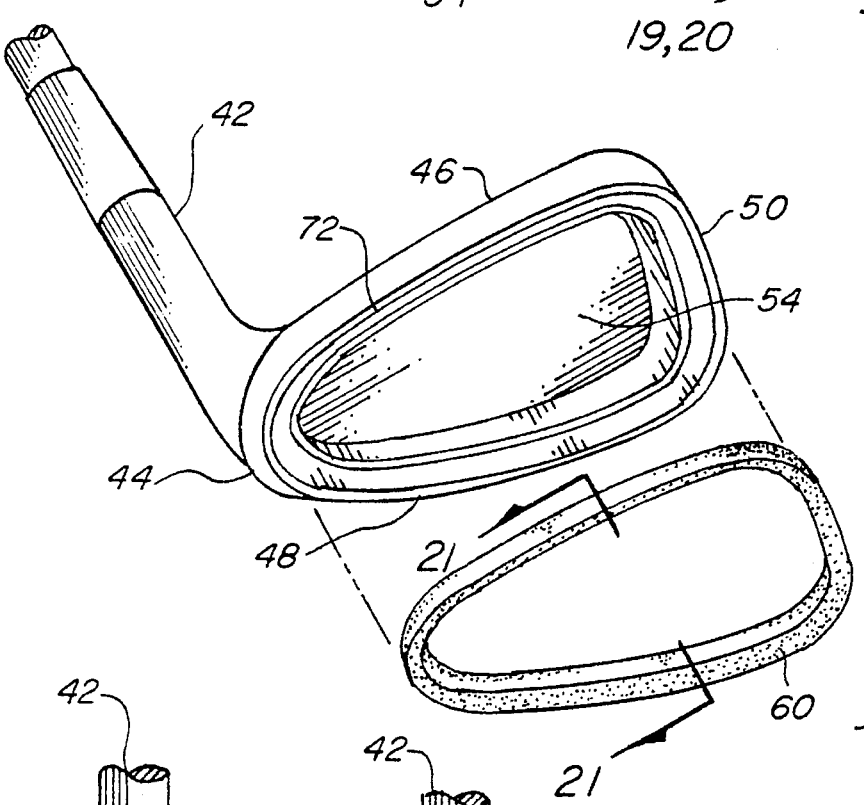
FIG. 18 is a exploded view of the head and skirt.

This embodiment may utilize the same skirt materials and fastening means as the skirt protected embodiment shown in FIGS. 11–16 except the channel 72 is bent inwardly to form a swaging rim as an alternate method for retaining the skirt 60 in the channel 72. As the body 40 of the club is metallic, this pair of integral extending legs form a rim of the channel 72 and are somewhat malleable permitting them to be bent or swaged inwardly creating permanent retention of the skirt 60 therebetween as shown in Fig. 17*a* .

Figure 19:
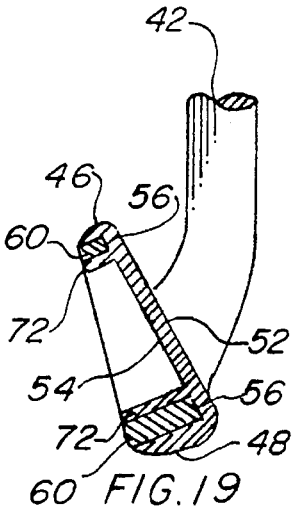
FIG. 19 is a cross sectional view taken along lines 19—19 of FIG. 17.
Figure 20:
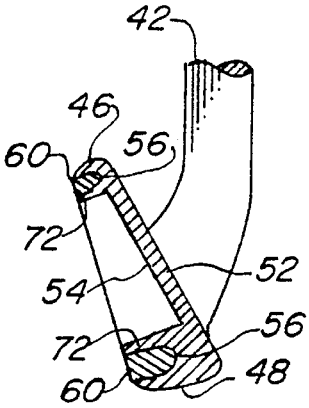
FIG. 20 is a cross sectional view taken along lines 20—20 of FIG. 17.
Figure 21:
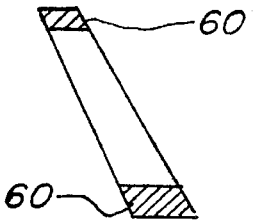
FIG. 21 is a cross sectional view taken along lines 21—21 of FIG. 18.
Figure 22:
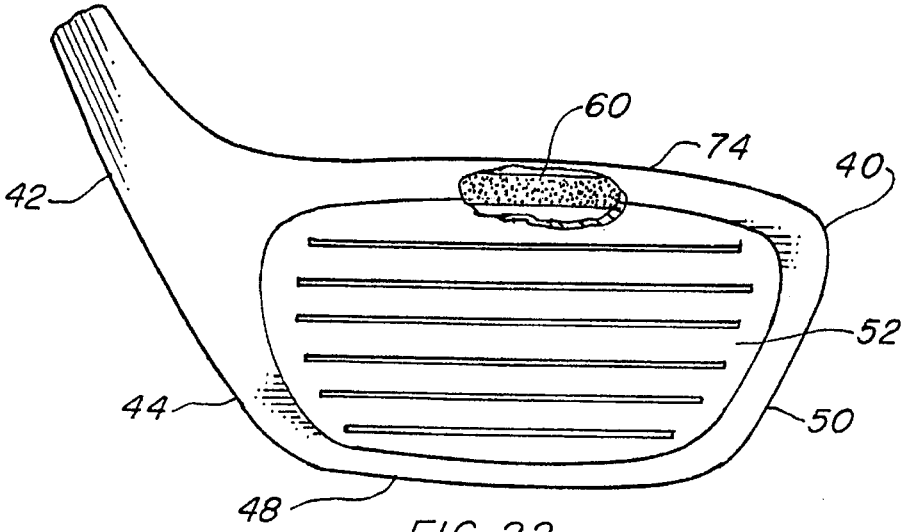
FIG. 22 is an elevational view of the preferred embodiment of the wood type golf club head with the skirt cast into the head shown partially cut away to illustrate the location of the skirt.
Figure 23:
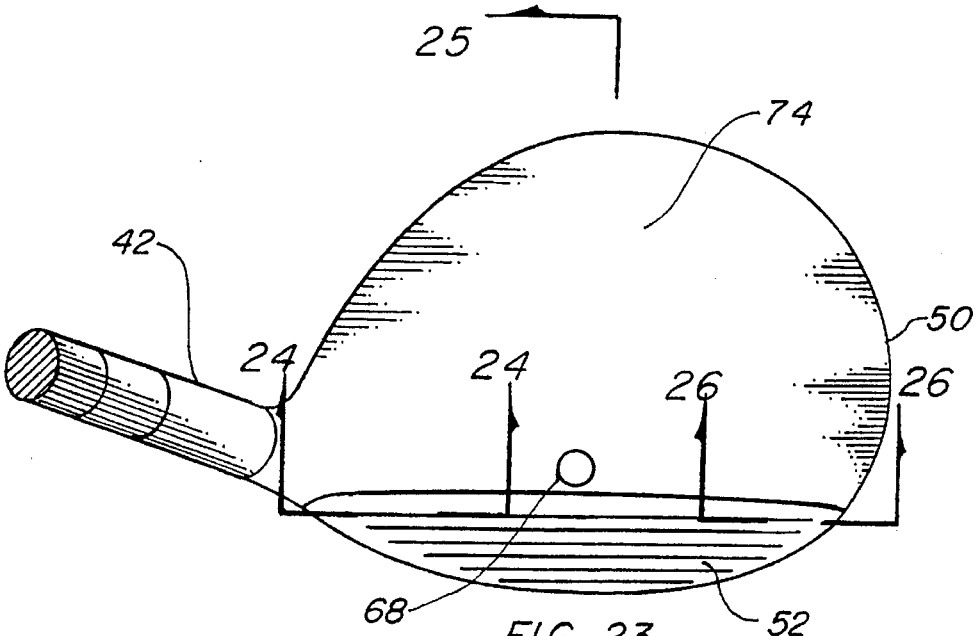
FIG. 23 is a top view of the preferred embodiment as above.
Figure 24:
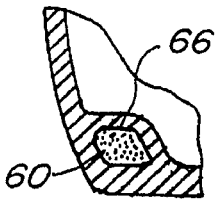
FIG. 24 is a cross sectional view taken along lines 24—24 of FIG. 23.
Figure 25:
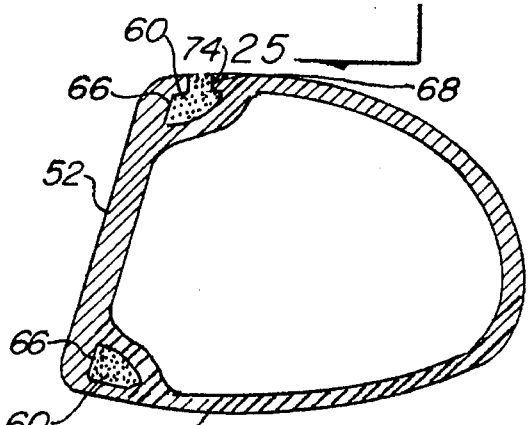
FIG. 25 is a cross sectional view taken along lines 25—25 of FIG. 23.
Figure 26:
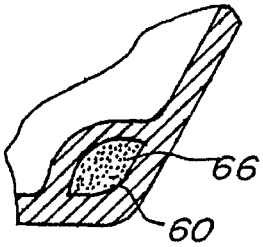
FIG. 26 is a cross sectional view taken along lines 26—26 of FIG. 23.
Figure 27:
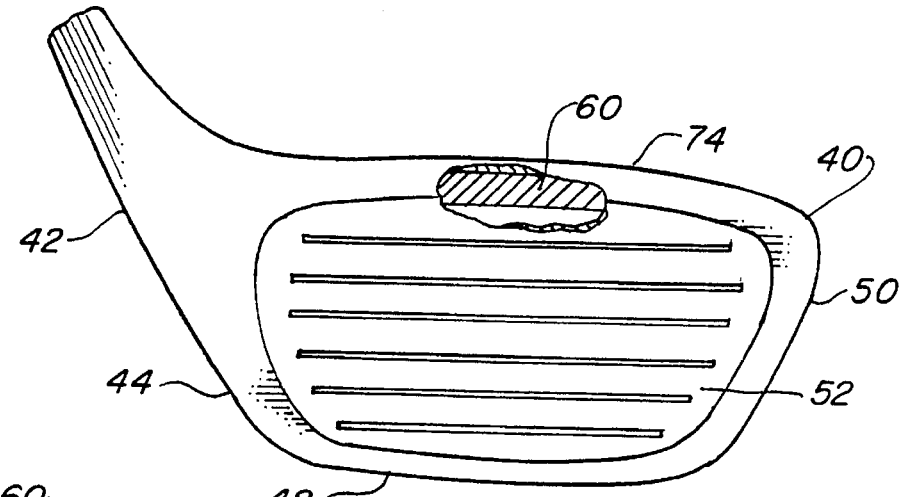
FIG. 27 is an elevation view of the preferred embodiment of the wood type golf club head with the skirt brazed, bonded or swaged inside the head shown partially cut away.
Figure 28:
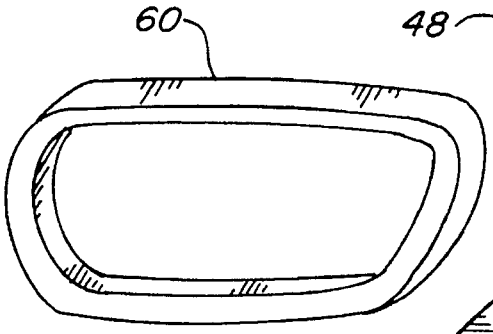
FIG. 28 is a partial isometric view of the skirt completely removed from the invention for clarity.
Figure 29:
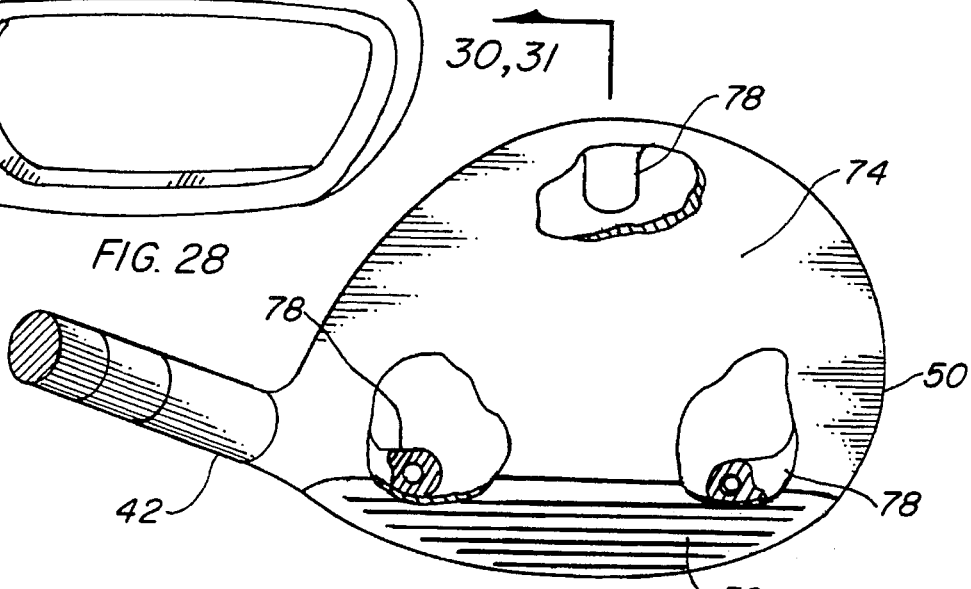
FIG. 29 is a top view of the preferred embodiment as above also partially cut away to illustrate the internal location of the skirt and removable sole plate and attaching method.

FIG. 20 illustrates an alternate configuration of the channel 72 and skirt 60 with the pair radiused and somewhat shorter and wider than the preferred embodiment shown in FIG. 19.

FIGS. 22–31 depict a perimeter weighted metallic wood-type golf club head of the hollow so called metal wood variety made entirely of metal with an empty inside area. This embodiment consists of the same body 40, hosel 42, heel 44, sole 48 and toe 50 except the upper portion is designated as a top 74 since there is no distinct top ridge. The front striking face 52 and rear wall 54, while of a different shape, still retain the same identification. The integral mating surface 56 is now inside the hollow body 40 opposite the striking face 52. The weighted skirt 60 is almost identical to the other embodiments with the exception of its exact configuration.

FIGS. 22–26 depict the hollow embodiment of the wood-type head with a hollow portion 66 completely surrounding the periphery of the body 40. Lead is also used for this skirt 60 embodiment. The lead is poured in a liquidous state through the fill hole 68 thus creating its own fastening means. Tungsten may be alternatively used if the body is cast or forged.

Figure 30:
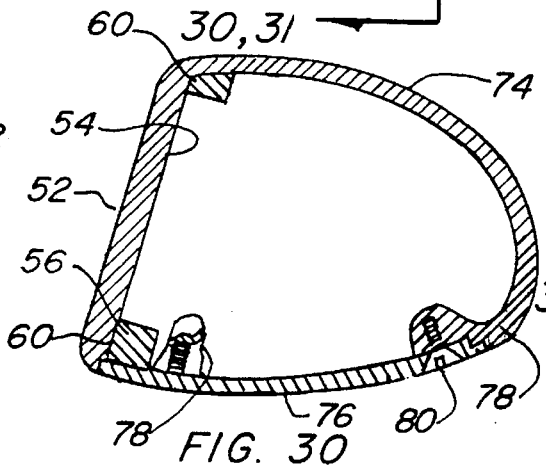
FIG. 30 is a cross sectional view taken along lines 30—30 of FIG. 29 illustrating bonding or brazing the skirt in place.

A second embodiment of the wood-type head is illustrated in FIGS. 27–31 and requires access inside the hollow portion of the body 40. This entry is provided by a removable sole plate 76 as part of the sole 48. FIG. 30 depicts this sole plate 76 and the threaded bosses 78 inside the hollow body that are used to attach the plate using threaded fasteners 80 in the form of screws or the like.

Figure 31A:
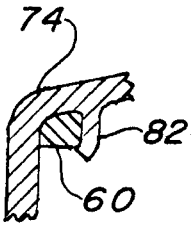
FIG. 31*a* is a cross-sectional view taken along lines 31*a*—31*a* of FIG. 31 illustrating the swaged skirt.
Figure 31:
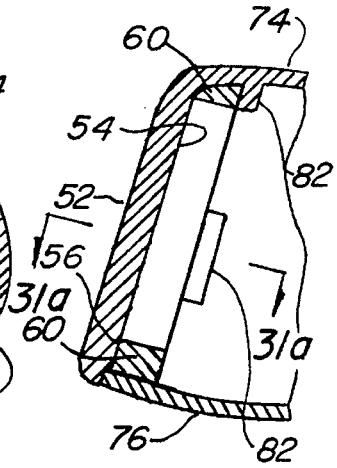
FIG. 31 is a cross sectional view taken along lines 31—31 of FIG. 29 illustrating the swaging the skirt in place.

The weighted skirt 60 in this embodiment may consist of lead, lead antimony alloy, tungsten, sintered tungsten with lead etc. inserted through the opening left when the sole plate 76 is removed. The fastening means may again include brazing with a filler metal 62, adhesive 64 and swaging the body mating surface 56 using a plurality of tabs 82 bent over the skirt 60 as illustrated in FIG. 31 and 31*a*.

While specific skirt 60 metals and combinations thereof have been delineated above, any metal heavier in equivalent mass weight than the body base material is acceptable including depleted uranium, sintered wolfram and lead or alloys of each, iridium and mercury, etc.

Figure 37:
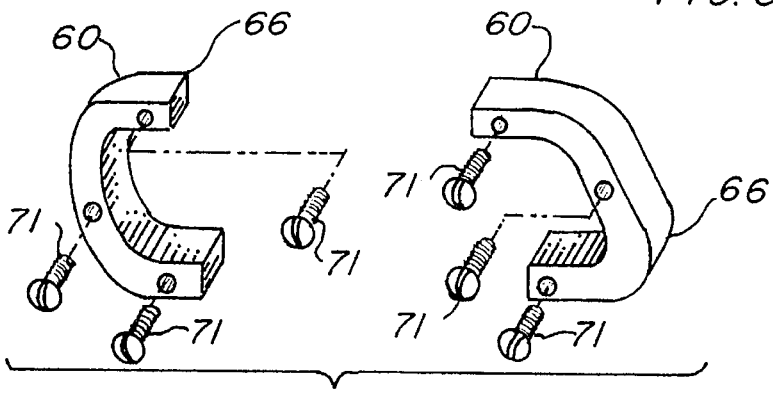
FIG. 37 is an exploded partial isometric view of the segmented skirt in opposed "U" shape with threaded fasteners, completely removed from the invention for clarity.
Figure 38:
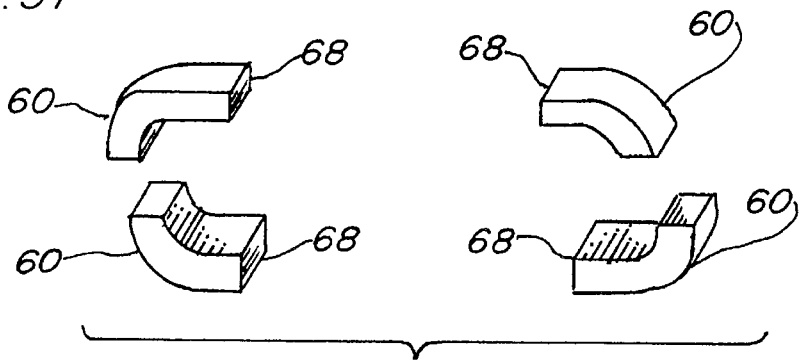
FIG. 38 is a partial isometric view of the segmented skirt four corners completely removed from the invention for clarity.

The third embodiment is illustrated specifically in FIGS. 33–38 and is the same as the preferred embodiment except the skirt is actually a segmented weighted skirt 61. The difference lies in the segments of the peripheral skirt thus being formed in pieces instead of a single mass. The segments may form a complete ring as depicted in FIG. 33 or may not surround the complete circumference such as shown in the "u" shape segment 62 of FIG. 35 and the inverted "C" shape segment 64 of FIG. 36. Further, plural segments may also be utilized as indicated in FIGS. 37 and 38. A pair of opposed u-shape segments 66 are shown in FIG. 37 and a plurality of corners 68 in FIG. 38.

It may clearly be seen that with this third embodiment, great flexibility is achieved as not only may the material be changed but any combination of material may be used with different segments and the actual width or breath may be changed in one set of segments to customize a club for an individual player.

Further, for customizing purposes, any of the skirts 60 may be attached to the club's flat surface 58 with fastening means 71 as illustrated in FIG. 37 allowing complete flexibility and modification at a later time if changes are required to provide the optimum club for the player.

While the embodiments of FIGS. 35–38 are illustrated for the putter configuration, the segments 61–68 may be applied to any of the preferred embodiments having a flat or a curved integral mating surface 56. The base metal of the segment may also be the same as previously described for the weighted skirt 60 of the preferred embodiment as well as the fastening means.

It will be seen from the above description that the golf club head of the present invention enhances the peripheral weighted art while transferring maximum energy to a ball that is inadvertently struck away from the precise center of percussion, thus maximizing the ability of any golfer to hit the ball in an optimum trajectory path.

While the invention has been described in complete detail and pictorially shown in the accompanying drawings it is not to be limited to such details, since many changes and modifications may be made in the invention without departing from the spirit and scope thereof. For example, the fastening means for attaching the skirt 60 to the club face cam be accomplished by attaching the skirt 60 from the front side of the club face by a plurality of counter-sunk screws or by a set of rivets. Additionally, a single segment or a plurality of segments protruding from the face of the body 40 could be used to aid in the alignment of the skirt 60 during the attachment procedure. Hence, it is described to cover any and all modifications and forms which may come within the language and scope of the appended claims.

I claim:

1. A perimeter weighted iron type golf club head comprising:

a) a metallic body characterized by, a hosel for attaching to a shaft, a heel angularly contiguous with the hosel, an upper top ridge and juxtapositioned sole, both interfacing with the heel, a toe connected to the top ridge and sole, this combination defining a front striking face and a rear wall, b) said body rear wall having an integral mating surface around an outside edge of the heel, top ridge, toe and sole, said body mating surface formed of a recessed channel having a pair of outwardly extending legs.

c) a mating peripheral weighted skirt of a dissimilar metal heavier in equivalent mass weight than the body base metal and of a peripheral shape conforming to the mating surface of the rear wall, and d) fastening means for joining the weighted skirt to the mating surface of the body rear wall, thereby locating the heads center of gravity rearward from the front striking face and said fastening means having each leg of the recessed channel bent inwardly forming a swaging rim captivating the skirt with parent metal of the mating surface channel.

2. A perimeter weighted iron type golf club head comprising:

a) a metallic body characterized by, a hosel for attaching to a shaft, a heel angularly contiguous with the hosel, an upper top ridge and juxtapositioned sole, both interfacing with the heel, a toe connected to the top ridge and sole, this combination defining a front striking face and a rear wall, b) said body rear wall having an integral mating surface around an out side edge of the heel, top ridge, toe and sole, said body mating surface formed into a protective raised peripheral lip, c) a mating peripheral weighted skirt of a dissimilar metal heavier in equivalent mass weight than the body base metal and of a shape in the form of a ring within the lip, and d) fastening means for joining the weighted skirt to the mating surface of the body rear wall thereby locating the heads center of gravity rearward from the front striking face and said fastening means further comprises an adhesive disposed between the skirt and the body raised peripheral lip.

3. A perimeter weighted metallic wood type golf club head comprising:

a) a body characterized by a hosel for attaching to a shaft, a heel angularly contiguous with the hosel, a sole and a juxtapositioned top both interfacing the heel, a toe connected to the top, this combination defining a front striking face and a rear wall, said body further having a hollow between the front striking face and the rear wall, top and sole said sole further having a removable sole plate within the sole of the head, b) an integral perimeter mating surface within the golf club head on an opposite side to the striking face, having a plurality of inwardly extending tabs integral with the mating surface, c) a mating weighted skirt of a dissimilar metal heavier in equivalent mass weight than the body base metal and of a shape conforming to said perimeter integral mating surface, and d) fastening means for joining the weighted skirt to the integral mating surface, thereby locating the heads center of gravity rearward of the striking face, said fastening means further comprises said tabs bent over the skirt swaging the tabs into the skirt, captivating the skirt with the tabs which are formed integrally with parent metal of the mating surface.

* * * * *